US009359987B2

(12) United States Patent
Reiter

(10) Patent No.: US 9,359,987 B2
(45) Date of Patent: Jun. 7, 2016

(54) INJECTOR

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 321 days.

(21) Appl. No.: 13/201,731

(22) PCT Filed: Dec. 14, 2009

(86) PCT No.: PCT/EP2009/067106

§ 371 (c)(1),
(2), (4) Date: Oct. 27, 2011

(87) PCT Pub. No.: WO2010/091759

PCT Pub. Date: Aug. 19, 2010

(65) Prior Publication Data

US 2012/0037727 A1 Feb. 16, 2012

(30) Foreign Application Priority Data

Feb. 16, 2009 (DE) ..... 10 2009 000 872

(51) Int. Cl.

| | |
|---|---|
| ***B05B 1/18*** | (2006.01) |
| ***A62C 31/00*** | (2006.01) |
| ***C10B 43/00*** | (2006.01) |
| ***C10B 33/00*** | (2006.01) |
| ***F02M 61/16*** | (2006.01) |

(52) U.S. Cl.

CPC ..... *F02M 61/168* (2013.01); *F02M 2200/16* (2013.01); *F02M 2200/858* (2013.01); *F02M 2200/9015* (2013.01); *F02M 2200/9038* (2013.01)

(58) Field of Classification Search

CPC ..... F02M 2200/16; F02M 2200/858; F02M 2200/9015; F02M 2200/9038

USPC ..... 239/533.1–533.9, 5, 585.1, 584, 562, 239/563, 553, 554, 590, 601, 104–123

See application file for complete search history.

(56) References Cited

U.S. PATENT DOCUMENTS

| | | | | |
|---|---|---|---|---|
| 4,294,215 | A * | 10/1981 | Hans et al. | 123/470 |
| 6,065,692 | A * | 5/2000 | Brinn, Jr. | 239/533.12 |
| 6,622,752 | B2 * | 9/2003 | Kushida et al. | 137/539.5 |
| 7,314,184 | B2 * | 1/2008 | Hornby | 239/88 |

(Continued)

FOREIGN PATENT DOCUMENTS

| | | |
|---|---|---|
| DE | 197 44 739 | 4/1999 |
| DE | 10 2006 0426 | 3/2008 |
| JP | 3712589 | 8/2005 |

(Continued)

*Primary Examiner* — Len Tran
*Assistant Examiner* — Alexander M Valis
(74) *Attorney, Agent, or Firm* — Norton Rose Fulbright US LLP

(57) ABSTRACT

An injector for the metered ejection of a fluid, in particular fuel, has a housing and a plastic extrusion coating, which encloses the housing, and from which the housing protrudes at an upper housing end on the fluid inlet side and at a lower housing end on the fluid ejection side. To achieve a so-called "fording capability" of the injector, the peripheral separation point of the housing and the plastic extrusion coating, at the lower end of the plastic extrusion coating, is sealed, preferably with the aid of a sealing collar.

7 Claims, 1 Drawing Sheet

(56) References Cited

U.S. PATENT DOCUMENTS

| | | | | |
|---|---|---|---|---|
| 8,505,835 | B2 * | 8/2013 | Scheffel | 239/585.5 |
| 8,770,498 | B2 * | 7/2014 | Reiter et al. | 239/585.3 |
| 2006/0016418 | A1 * | 1/2006 | Aoki et al. | 123/296 |
| 2008/0006713 | A1 * | 1/2008 | Parish | 239/5 |

FOREIGN PATENT DOCUMENTS

| | | | | |
|---|---|---|---|---|
| JP | 2006-90278 | | 4/2006 | |
| JP | 3899937 | | 1/2007 | |
| WO | WO 2007/014887 | | 2/2007 | |
| WO | WO 2007014887 | A1 * | 2/2007 | F02M 51/00 |

* cited by examiner

INJECTOR

FIELD OF THE INVENTION

The present invention is directed to an injector for the metered ejection of a fluid, in particular fuel.

BACKGROUND INFORMATION

A known fuel injector (German Patent Application No. DE 197 44 739) has a housing assembled from multiple parts, of which one part is formed by an inlet stub having a fuel feed and one part is formed by a sleeve which is stepped in diameter. The tubular inlet stub plunges into the larger-diameter sleeve section of the sleeve and partially into the smaller-diameter sleeve section of the sleeve and carries, on its plunging end, a solenoid coil of an electromagnet which drives a valve needle, whose armature, which is fixedly connected to the valve needle, is guided axially displaceable in the end of the inlet stub plunging into the smaller-diameter sleeve section. The open end of the smaller-diameter sleeve section is closed by a valve body, on which a valve seat which surrounds a valve opening is formed. A closing head formed on the end of the valve needle interacts with the valve seat to release and close the valve opening. A perforated injection disc is situated downstream from the valve body. The area of the inlet stub protruding from the sleeve is enclosed by a plastic extrusion coating, which covers the opening of the larger-diameter sleeve section of the sleeve and ends at a distance from the intake-side end of the inlet stub. A connection plug for a solenoid coil of the electromagnet is embedded in the plastic extrusion coating. The fuel injector is inserted into a valve receptacle in the cylinder head of an internal combustion engine and sealed against the wall of the valve receptacle using two sealing rings. A lower sealing ring is accommodated in a ring groove provided on the ejection-side, lower end of the smaller-diameter sleeve section of the sleeve and an upper sealing ring is pushed onto the intake-side upper end of the inlet stub, which protrudes from the plastic extrusion coating. After installation of the injector in the valve receptacle, the upper sealing ring presses against the ring-shaped front face of the plastic extrusion coating.

SUMMARY OF THE INVENTION

The injector according to the present invention has the advantage that long-term absolute tightness of the injector is ensured by the additional sealing of the lower attachment point of the plastic extrusion coating on the housing of the injector and no corrosion damage occurs in the housing interior, e.g., on the solenoid coil. The injector is thus "fording-capable", i.e., insensitive to immersion in water, mud, and the like, as is required in the case of off-road and utility vehicles.

According to an advantageous specific embodiment of the present invention, the additional sealing of the housing is implemented by a sealing collar which overlaps the lower separation point between housing and plastic extrusion coating, and which presses on one side against the plastic extrusion coating and on the other side against the housing. Using such a sealing collar, which is preferably made of an elastomeric material, the tightness is reliably achieved in a simple manufacturing process, without interfering in the valve design.

According to an advantageous specific embodiment of the present invention, the plastic extrusion coating is provided with a peripheral external groove close to its upper end and a sealing ring is inserted in the external groove for sealing in relation to the valve receptacle. The fording capability of the injector is also ensured by this upper sealing ring in installation locations in which the injector is inserted transversely or overhead, so that, for example, the intake-side end of the injector is lower than the injection-side end.

DETAILED DESCRIPTION

Figure 2:
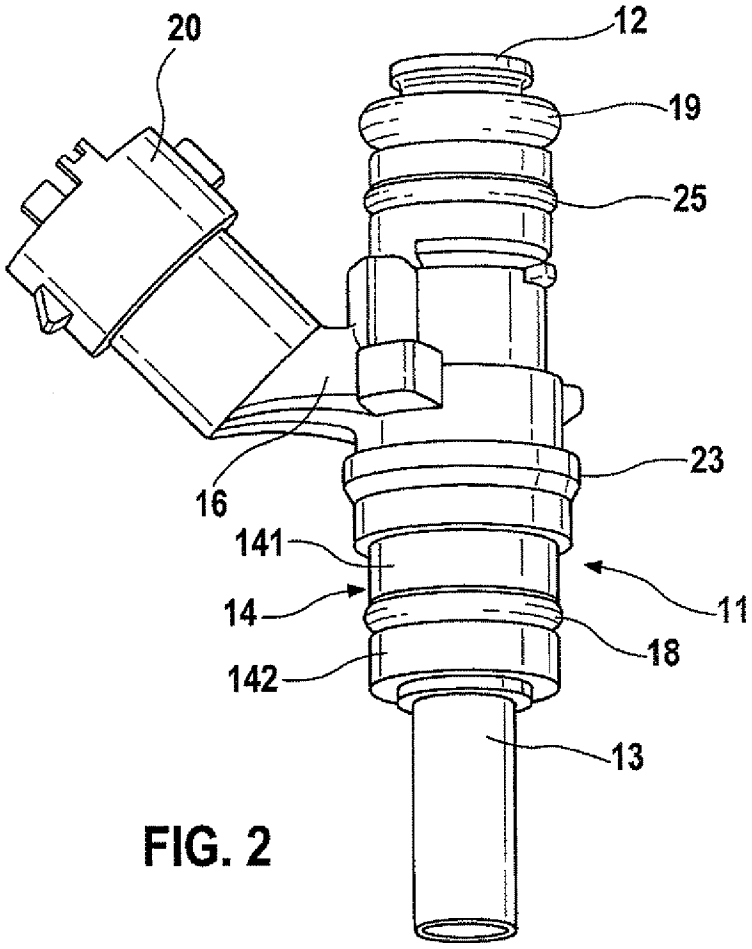
FIG. 2 shows a perspective side view of the injector in FIG. 1.
Figure 1:
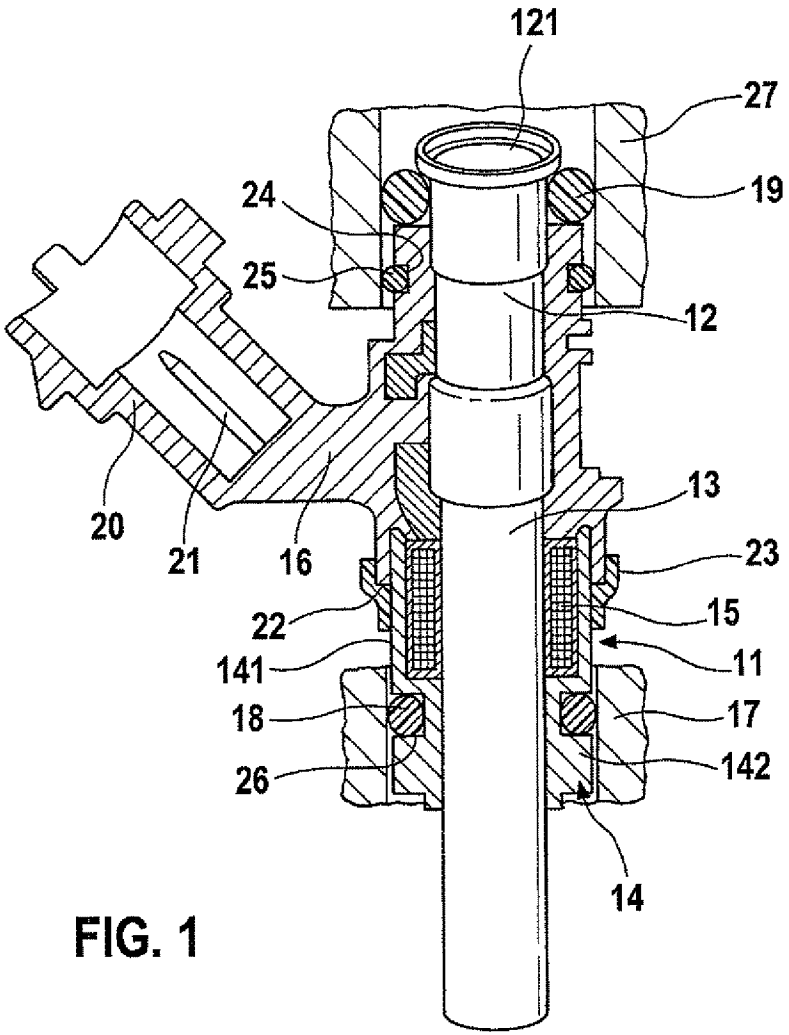
FIG. 1 shows a longitudinal section of an injector.

The injector, which is shown in a perspective side view in FIG. 2 and in section in FIG. 1, is used, for example, for injecting fuel into an intake duct leading to a combustion chamber of an internal combustion engine or directly into the combustion chamber of the internal combustion engine or for metered ejection of another fluid, e.g., urea-water solutions into exhaust systems of internal combustion engines for the purpose of reducing nitrogen oxides contained in the exhaust gas. The injector has a housing 11, which is assembled from three housing parts, an inlet stub 12 having inlet opening 121 for the fluid, a valve tube 13, into which the end of inlet stub 12 plunges, and a housing sleeve 14, which is pushed onto valve tube 13, having sleeve sections 141 and 142, which have two different internal diameters. Sleeve section 141 having the larger internal diameter encloses a solenoid coil 15, which is seated on valve tube 13, of an electromagnet for actuating a valve needle situated in the interior of valve tube 13. The valve needle is fixedly connected in a known way to an armature of the electromagnet and pressed against a valve seat of the injector, which encloses a valve opening, under the action of a valve closing spring having a closing head, which is situated in valve tube 13. Sleeve section 142 of housing sleeve 14 having the smaller internal diameter is seated in a form-locked way on valve tube 13.

Housing 11 is enclosed by a plastic extrusion coating 16, from which housing 11 protrudes axially at its upper housing end on the fluid inlet side and at its lower housing end on the fluid ejection side. The upper housing end on the fluid inlet side is formed by an end section of inlet stub 12 and the lower housing end on the fluid ejection side is formed by a part of sleeve section 141 having the larger internal diameter and entire sleeve section 142 having the smaller internal diameter. A connection plug 20, whose two plug contacts 21 are connected to the winding of solenoid coil 15, is embedded in plastic extrusion coating 16. The injector is typically inserted into valve receptacles 17, 27, as are partially indicated in FIG. 1. In the case of a fuel injector, lower valve receptacle 17 is a hole in the cylinder head of a combustion cylinder of the internal combustion engine and upper valve receptacle 27 is a hole in a fuel rail, which is fastened on the cylinder head. To seal housing 11 in relation to valve receptacles 17, 27, two sealing rings 18, 19 are provided, of which a lower sealing ring 18 is inserted in a ring groove 26, which is grooved in housing 11, more precisely in sleeve section 142 having the smaller internal diameter, and an upper sealing ring 19 is seated on the section of inlet stub 12 protruding from plastic extrusion coating 16.

In order to prevent corrosion damage in the interior of housing 11, in particular on solenoid coil 15, as may occur during use of the injector in motor vehicles which are subjected to rough operation, by penetration of water at the separation point between housing 11 and plastic extrusion coating 16, peripheral separation point 22 of housing 11 and plastic extrusion coating 16 at the lower end of plastic extrusion coating 16 are sealed, i.e., made watertight. A sealing collar 23, which is preferably made of an elastomeric material, is used for this purpose in the illustrated exemplary embodiment, which presses on one side against plastic extrusion coating 16 and on the other side against housing 11, more precisely against sleeve section 141 of housing sleeve 14 having the larger internal diameter. In addition, plastic extrusion coating 16 is provided close to its upper end with a peripheral external groove 24, and a sealing ring 25, e.g., an O-ring, is inserted into external groove 24, which presses against the inner wall of valve receptacle 17. This sealing ring 25 is particularly advantageous if an installation location of the injector is required in which inlet opening 121 of inlet stub 12 is possibly spatially located below the injection opening of the injector and therefore this area is also subjected to water, mud, and the like to an increased extent during operation of the motor vehicle, or operating states occur in which the injector is completely immersed in water.

What is claimed is:

1. An injector for a metered ejection of a fluid, comprising:

a housing; and a plastic extrusion coating, which encloses the housing, and from which the housing protrudes at an upper housing end on a fluid inlet side and at a lower housing end on a fluid ejection side, wherein the housing has a sleeve section which laterally accommodates a magnetic coil that drives a valve needle, wherein an upper end of the sleeve section is overlapped by a lower end of the plastic extrusion coating, wherein a peripheral separation point of the housing and the plastic extrusion coating, on the lower end of the plastic extrusion coating, is sealed by a sealing collar, wherein the sealing collar presses on one side against a radially outer surface of the plastic extrusion coating and on another side against the sleeve section, wherein an outside diameter of the sealing collar is greater than an inside diameter of a lower valve receptacle, wherein the lower valve receptacle is at least one of (1) a hole in a cylinder head of a combustion cylinder of an internal combustion engine, (2) a hole in an intake duct of the internal combustion engine and (3) a hole in an exhaust pipe of the internal combustion engine, wherein the housing includes an inlet stub having an inlet opening for the fluid, a valve tube, into which the end of the inlet stub plunges, and the housing having a first sleeve section having a larger internal diameter and a second sleeve section having a smaller internal diameter, the first sleeve section having the larger internal diameter enclosing the magnetic coil, which is seated on the valve tube, wherein an upper housing end on a fluid inlet side is formed by an end section of the inlet stub and a lower housing end on the fluid ejection side is formed by the first sleeve section and the second sleeve section, and wherein the sealing collar is positioned around at least part of the first sleeve section, which surrounds at least part of the magnetic coil.

2. The injector according to claim 1, wherein the fluid is fuel.

3. The injector according to claim 1, wherein the sealing collar is made of an elastomeric material.

4. The injector according to claim 1, wherein the plastic extrusion coating has a peripheral external groove close to its upper end, and a sealing ring for sealing in relation to an upper valve receptacle is inserted into the external groove.

5. The injector according to claim 4, wherein the upper valve receptacle is a hole in a fuel rail.

6. An injector for a metered ejection of a fluid, comprising:

a housing; and a plastic extrusion coating, which encloses the housing, and from which the housing protrudes at an upper housing end on a fluid inlet side and at a lower housing end on a fluid ejection side, wherein a peripheral separation point of the housing and the plastic extrusion coating, on a lower end of the plastic extrusion coating, is sealed by a sealing collar, wherein the sealing collar presses on one side against a radially outer surface of the plastic extrusion coating, wherein an outside diameter of the sealing collar is greater than an inside diameter of a lower valve receptacle, wherein the lower valve receptacle is at least one of (1) a hole in a cylinder head of a combustion cylinder of an internal combustion engine, (2) a hole in an intake duct of the internal combustion engine and (3) a hole in an exhaust pipe of the internal combustion engine, wherein the plastic extrusion coating has (1) a peripheral external groove close to its upper end, and a first sealing ring for sealing in relation to an upper valve receptacle is inserted into the external groove and (2) a second sealing ring seated on the upper end of the plastic extrusion coating, wherein the housing includes an inlet stub having an inlet opening for the fluid, a valve tube, into which the end of the inlet stub plunges, and a housing sleeve having a first sleeve section having a larger internal diameter and a second sleeve section having a smaller internal diameter, the first sleeve section having the larger internal diameter enclosing a solenoid coil, which is seated on the valve tube, wherein an upper housing end on a fluid inlet side is formed by an end section of the inlet stub and a lower housing end on the fluid ejection side is formed by the first sleeve section and the second sleeve section, and wherein the sealing collar is positioned around at least part of the first sleeve section, which surrounds at least part of the solenoid coil.

7. An injector for a metered ejection of a fluid, comprising:

a housing; and a plastic extrusion coating, which encloses the housing, and from which the housing protrudes at an upper housing end on a fluid inlet side and at a lower housing end on a fluid ejection side, wherein the housing has a sleeve section which laterally accommodates a magnetic coil that drives a valve needle, wherein an upper end of the sleeve section is overlapped by a lower end of the plastic extrusion coating, wherein a peripheral separation point of the housing and the plastic extrusion coating, on a lower end of the plastic extrusion coating, is sealed by a sealing collar, wherein the sealing collar presses on one side against a radially outer surface of the plastic extrusion coating and on another side against the sleeve section, wherein the housing includes an inlet stub having an inlet opening for the fluid, a valve tube, into which the end of the inlet stub plunges, and the housing having a first sleeve section having a larger internal diameter and a second sleeve section having a smaller internal diameter, the first sleeve section having the larger internal diameter enclosing the magnetic coil, which is seated on the valve tube, wherein an upper housing end on a fluid inlet side is formed by an end section of the inlet stub and a lower housing end on the fluid ejection side is formed by the first sleeve section and the second sleeve section, and wherein the sealing collar is positioned around at least part of the first sleeve section, which surrounds at least part of the magnetic coil.

* * * * *